US007151537B1

(12) United States Patent
Von Hase

(10) Patent No.: US 7,151,537 B1
(45) Date of Patent: Dec. 19, 2006

(54) METHOD AND DEVICE FOR ADJUSTING THE PHASE FOR FLAT SCREENS

(75) Inventor: Paul Von Hase, Munich (DE)

(73) Assignee: Fujitsu Siemens Computers GmbH, Munich (DE)

( * ) Notice: Subject to any disclaimer, the term of this patent is extended or adjusted under 35 U.S.C. 154(b) by 0 days.

(21) Appl. No.: 09/926,210

(22) PCT Filed: Mar. 16, 2000

(86) PCT No.: PCT/DE00/00819

§ 371 (c)(1),
(2), (4) Date: Oct. 19, 2001

(87) PCT Pub. No.: WO00/58936

PCT Pub. Date: Oct. 5, 2000

(30) Foreign Application Priority Data

Mar. 26, 1999 (DE) ..... 199 13 916
Aug. 25, 1999 (DE) ..... 199 40 384

(51) Int. Cl.
*G09G 5/00* (2006.01)

(52) U.S. Cl. ..... 345/213; 345/211; 345/212

(58) Field of Classification Search ..... 345/211–213, 345/87–89; 348/537
See application file for complete search history.

(56) References Cited

U.S. PATENT DOCUMENTS 4,713,691 A * 12/1987 Tanaka et al. ..... 348/537
4,943,857 A * 7/1990 Izuno et al. ..... 348/537
4,996,596 A * 2/1991 Hirao et al. ..... 348/542
5,926,174 A * 7/1999 Shibamiya et al. ..... 345/213
5,990,968 A * 11/1999 Naka et al. ..... 348/537
6,323,910 B1 * 11/2001 Clark, III ..... 348/537

FOREIGN PATENT DOCUMENTS

| | | |
|---|---|---|
| DE | 39 14 249 | 12/1990 |
| DE | 39 14 249 A1 | 12/1990 |
| DE | 197 51 719 | 5/1999 |
| DE | 197 51 719 A1 | 5/1999 |
| EP | 0 805 430 | 11/1997 |
| EP | 0 805 430 A1 | 11/1997 |
| WO | WO 98/25401 | 6/1998 |

* cited by examiner

*Primary Examiner*—Richard Hjerpe
*Assistant Examiner*—Kimnhung Nguyen
(74) *Attorney, Agent, or Firm*—Cohen, Pontani, Lieberman & Pavane

(57) ABSTRACT

A method and a device for correcting the phase between the pixel clock of a graphics card and the sampling clock of a flat-panel display with an analog interface in a system including a flat-panel display, graphics card, and computer. Automatic adjustment of the phase is performed repeatedly. In the process, the rising edge of a video pulse of a sufficiently bright image spot in the first image column close to the back-porch region is determined. The falling edge of a video pulse is determined at a sufficiently bright image spot in the last image column close to the front-porch region, and the phase is adjusted such that the sampling instant is situated approximately at the midpoint between the rising and falling edges of a video pulse.

35 Claims, 4 Drawing Sheets

Fast Video Signal with Overshoot

Slow Video Signal

Rising Edge
First Image Spot

Falling Edge
Last Image Spot

Ideal Video Signal

Sampling Pulse with Jitter

Ideal Video Signal

Sampling Pulse with Jitter

METHOD AND DEVICE FOR ADJUSTING THE PHASE FOR FLAT SCREENS

RELATED APPLICATION

This application is a U.S. Continuation Application under 35 USC 371 of International Application PCT/DE00/00819 filed Mar. 16, 2000.

The invention relates to a method and a device for correcting the phase between the pixel clock of a graphics card and the sampling clock of a flat-panel display with an analog interface in a system comprising flat-panel display, graphics card and computer.

Flat-panel displays with an analog interface must be adapted to the graphics card of the connected computer. If phase or sampling frequency is incorrectly adjusted, the image appears fuzzy and contains interferences. Whereas the values for image location, or in other words right-left and top-bottom adjustment, and for sampling frequency can be defined as preadjusted values in the case of standard modes, this is not possible for the phase, since the phase depends on the graphics card used and also on the video circuit.

Prior art flat-panel displays are usually provided with a microprocessor, which is responsible for general control of the flat-panel display. This microprocessor is configured such that it can also recognize the video mode adjusted on the computer. If the mode has already been adjusted at the factory or by the user, the flat-panel display is operated with the stored adjustments for image location, sampling frequency and phase. On the other hand, if the mode is one which has not yet been implemented in the microprocessor of the flat-panel display, standard values are assumed for image location, sampling frequency and phase. These standard values are not satisfactory in all cases.

The adjustment of the sampling clock and of the phase have a direct effect on image quality. An optimal sampling frequency is achieved when the sampling of all pixels, in one line of a video signal, for example, takes place in a stable or characteristic region of these pixels, such as at the center of each pixel. Data conversion then yields optimal results. The displayed image does not contain any interferences, and is stable. In other words, the optimal sampling frequency is equal to the pixel frequency. If an incorrect sampling frequency has been adjusted, for example if the sampling clock is too fast compared with the pixel clock, the pixels are sampled at first in the permissible region, or in other words at the midpoint between two edges, but the subsequent pixels are sampled progressively more toward one edge, until even the region between two pixels is sampled, which obviously leads to unsatisfactory image quality. Incorrect sampling values are derived from the region in which the pixels are not sampled in an optimal, characteristic region. The image then exhibits strong vertical interference. The number of regions with vertical interference that are visible on the monitor increases as the difference between the frequencies of the sampling clock and the pixel clock becomes larger.

Even in the cases in which the sampling clock is identical to the pixel clock, however, the image quality can suffer if the phase has not been adjusted correctly. The reason is that sampling takes place in a pixel region that is not ideally suitable for sampling, for example too close to the leading or trailing edge of a pixel. This problem can be solved by shifting the phase, or in other words the sampling instant, as the whole until sampling takes place in a characteristic or permissible region of the pixels. If the phase has not been adjusted correctly, the image quality is impaired by noise signals over the entire monitor.

Flat-panel displays with analog interfaces, in which phase adjustment is automatically performed, are already known. For such automatic phase-position adjustment, special test patterns with alternating white and black image spots are usually necessary, and the test pattern must be displayed by the graphics card. This has the disadvantage that software must be installed and started on the computer, and furthermore that this software must be available for all common operating systems.

For satisfactory operation of the flat-panel display, it is also desired that the phase adjustment be stable even over the long term. Among analog interfaces, it is known that the analog interface is not 100% stable. For example, run times and other characteristics vary with temperature. This instability of the analog interface also affects the image quality of the flat-panel display. In other words, even if the sampling phase is correctly adjusted when the computer is turned on, after a certain time, such as 30 minutes, the phase had undergone a drift, which then leads to a reduction of image quality and also, in many cases, to questions via the supplier's hotline.

In this regard, the object of the invention is to provide a method and a device for correcting the phase in flat-panel displays, whereby a continuously correct adjustment of the phase is possible.

To achieve this object, the inventive method is characterized in that automatic adjustment of the phase is performed repeatedly. For this purpose, continuous or periodic adjustment of the phase is preferred. In other words, the phase is repeatedly corrected either continuously or periodically during operation of the flat-panel display, thus compensating for drift due to temperature fluctuations or other influences on the flat-panel display. Thus the flat-panel display is always available with optimal image quality.

According to an advantageous embodiment of the inventive method, the phase adjustment necessary for the instantaneous condition of the system is determined only at individual image spots, and the determined phase adjustment is then applied to the entire image. In order to determine the phase adjustment suitable for the instantaneous condition of the system, the phase must be adjustable. Thus, if such an adjustment is to be performed during operation of the flat-panel display, the flat-panel display would be temporarily unavailable during the phase adjustment. If the phase shift necessary for the phase adjustment takes place only at individual image spots, however, the image is temporarily distorted only at these individual image spots, and this is not at all perceptible in practice. With this embodiment of the inventive method, therefore, the phase can be corrected during operation of the flat-panel display.

A further advantageous embodiment of the inventive method is characterized in that the pixel or pixels that is or are influenced or distorted by matching is or are masked by distortion-free image fragments from a video memory. In this way the influence of matching on image quality is further reduced.

A further advantageous embodiment of the inventive method is characterized in that the video memory is repeatedly regenerated, preferably after every second image, in order to avoid relatively large deviations between the current image and the image in the video memory, which is supposed to replace partial zones of the current image.

A further advantageous embodiment of the inventive method is characterized in that a sufficiently bright image spot is selected and the rising edge of a video pulse of this image spot is determined, in that a sufficiently bright image spot is selected and the rising edge of a video pulse of this image spot is determined, and in that the phase is adjusted such that the sampling instant for the entire image is situated approximately at the midpoint between the rising and falling edges of the video pulse.

An advantageous embodiment of the inventive method is characterized in that the rising edge of a video pulse of a sufficiently bright image spot is determined, and in that the phase is adjusted such that the sampling instant is shifted by approximately half the width of an image spot toward the center of the pixel.

An advantageous embodiment of the inventive method is characterized in that the falling edge of the video pulse is determined at a sufficiently bright image spot, and in that the phase is adjusted such that the sampling instant is shifted by approximately approximately half the width of an image spot toward the center of the pixel.

Whereas the image-location and sampling frequencies can be determined and correspondingly adjusted relatively simply by an algorithm, the phase position is more difficult to determine. The last three of the foregoing practical examples of the inventive method are simple and satisfactory methods for adjusting the phases, especially since no test patterns and no corresponding software are necessary in order to undertake automatic phase adjustment.

An advantageous embodiment of the inventive method, wherein the image area and image spots are arrayed on the flat-panel display in rows and columns between a back-porch region and a front-porch region, is characterized in that an image spot in the first image column close to the back-porch region is chosen as the sufficiently bright image spot for determination of the rising edge and an image spot in the first image column close to the front-porch region is chosen as the sufficiently bright image spot for determination of the falling edge. The method can be performed particularly well if the most pronounced possible edges are evaluated or if regions or spots disposed next to one another have very different brightness. Thus a spot in the first or last image column is particularly suitable, since it completely satisfies the required conditions in combination with the front-porch or back-porch region respectively, and can be found with relatively little difficulty.

An advantageous embodiment of the inventive method is characterized in that the brightness of a plurality of image spots of the first or last image column is measured, and the image spots with the greatest or sufficient brightness in the first or last image column are chosen for determination of the rising or falling edge respectively of the video pulse. In this way it is ensured that image spots with sufficiently pronounced edges are used for the measurement.

An advantageous embodiment of the inventive method is characterized in that the image spots ($n \times k$) are first measured with $n=1, 2, \ldots N$ and $k$=constant, such as 10, and in that, if no sufficiently bright image spot was found, the image spots $(n+m) \times k$ are measured with $m=1, 2, \ldots N$, until a sufficiently bright image spot is found. Thereby a search for suitable image spots is performed efficiently and in the shortest time.

An advantageous embodiment of the inventive method is characterized in that, for determination of the amplitude values of the selected image spots, the phases at these image spots are shifted until the measured amplitude values no longer change significantly, and in that the amplitude values then determined are further processed.

Alternatively, an advantageous embodiment of the inventive method is characterized in that the phase used for determination of the amplitude value is advanced sufficiently that the measured amplitude values are smaller than a predetermined limit value, for example smaller than 50% of the amplitude value, in that the phase is delayed by half the width of a spot, and in that the amplitude value then measured is further processed.

The last two of the foregoing embodiments of the inventive method are simple solutions in order to determine the brightness of the image spot as a prerequisite for determination of the position of the rising and falling edge of the image spot.

A further advantageous embodiment of the invention is characterized in that, for determination of the rising edge of the selected image spots, the phase at the selected image spot is shifted sufficiently toward the back-porch region that the measured amplitude value is reduced to a predetermined percentage, for example 50%, of the previously determined amplitude value, and in that this value of the phase is stored temporarily as the position of the rising edge. Yet another advantageous embodiment of the invention is characterized in that, for determination of the falling edge of the selected image spots, the phase at the selected image spot is shifted sufficiently toward the front-porch region that the measured amplitude value is reduced to a predetermined percentage, for example 50%, of the previously determined amplitude value, and in that this value of the phase is stored temporarily as the position of the falling edge. In this way the rising and falling edges of two image spots are determined in simple manner, and the phase can then be adjusted such that it is located between the rising and falling edges at approximately the center of an image spot.

A further advantageous embodiment of the invention is characterized in that the phase or sampling instant is delayed relative to the midpoint between the rising and falling edges by a predetermined amount, for example 10% of the width of the image spot. This is advantageous in particular for rapid video signals with overshoots, since it prevents sampling from taking place in the region of the overshoot.

A further advantageous embodiment of the inventive method is characterized in that the sampling instant can be changed by the user compared with the value determined during matching, in which case an offset adjusted in this way is taken into consideration during automatic matching. Thus, depending on the graphics card being used, the sampling instant can be advantageously advanced or retarded slightly relative to the value determined by matching. The offset can be adjusted, for example, via the OSD.

To achieve the object cited hereinabove, the device for correcting the phase between the pixel clock of a graphics card and the sampling clock of a flat-panel display having an analog interface in a system comprising a flat-panel display, graphics card and computer, is characterized by a device by which automatic adjustment of the phase is performed repeatedly, preferably continuously or periodically.

An advantageous embodiment of the inventive device is characterized by an adjusting device for shifting the phase, comprising a circuit containing two PLL circuits, whose outputs can be adjusted independently of one another as regards their phase.

A further advantageous embodiment of the inventive device is characterized by an adjusting device for shifting the phase, comprising a PLL circuit with two clock outputs, whose output clock signals can be adjusted independently of one another as regards their phase.

The last two of the foregoing advantageous embodiments of the inventive device have the advantage that the phase can be shifted within a single clock pulse in simple manner. By changing over between the two digital clock outputs of the PLL circuit, it is possible, since transients are absent, to switch forward and back without delay between the already adjusted phase positions of the second outputs.

A further advantageous embodiment of the inventive device is characterized in that the two outputs of the PLL circuit optionally deliver a sampling clock signal for matching and a clock signal for the entire image. Thereby the need to receive the phase is advantageously eliminated. An electronic changeover unit can then decide simply which output is responsible at which instant for which sampling signal.

A further advantageous embodiment of the inventive device is characterized in that the sampling clock is delivered alternately by the two outputs of the PLL circuit.

A further advantageous embodiment of the inventive device is characterized by a PLL circuit which is programmed such that it oscillates at an integral multiple of the needed sampling frequency, and by a downstream frequency divider, which divides the sampling frequency of the PLL circuit by a factor n, wherein n sampling signals phase-shifted by 1/n periods relative to one another can be generated. In this case it is further advantageous for the factor n=2 to be used and, when the phase of the PLL circuit is adjusted such that the one sampling signal is in phase with one edge of the pixel, the other sampling signal is phase-shifted by ½ pixel. As will be explained hereinafter, this is then the ideal sampling point for sampling the pixel. The circuit necessary for this purpose is simple and inexpensive.

A further advantageous embodiment of the inventive device is characterized by a device which determines the rising edge of a video pulse of a sufficiently bright image spot, a device that determines the falling edge of the video pulse at a sufficiently bright image spot, and an adjusting device with which the phase is adjusted such that the sampling instant is located at approximately the midpoint between the rising and the falling edges of a video pulse.

Further advantageous embodiments of the inventive method and of the inventive device are evident from the remaining dependent claims.

Practical examples of the invention will be described hereinafter with reference to the attached drawings, wherein:

FIG. 1 shows a control circuit for a flat-panel display that can be connected via an analog interface;

FIG. 2 schematically shows a horizontal synchronization signal and a channel of a video signal, such as the R video signal (R=red color);

FIG. 3 schematically shows the horizontal synchronization signal and several lines of a channel of a video signal;

Figure 1:
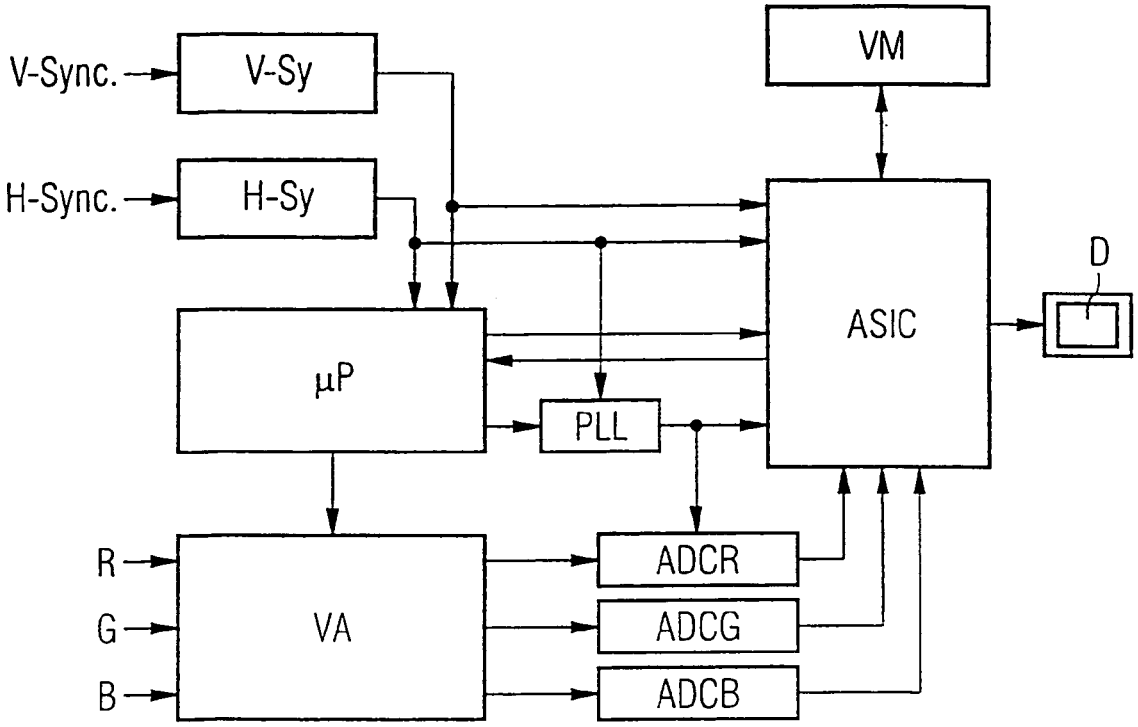

FIG. 1 shows a control circuit for a flat-panel display, which can be connected via an analog interface, and whose function will be explained in more detail hereinafter with reference to the various input signals and their conditioning. At the input of the control circuit there are applied on the one hand the video signal comprising the three color signals R, G, B, and on the other hand the two synchronization signals H-sync and V-sync for horizontal and vertical image synchronization. H-sync and V-sync are transmitted digitally, with signal voltages of 0 V and >3 V respectively. V-sync signals that the first line of an image is being transmitted. This signal therefore corresponds to the image refresh frequency and is typically in the range between 60 and 85 Hz. H-sync signals that a new image line is being transmitted. This signal corresponds to the line frequency and is usually around 60 kHz.

The video signal made up of the color signals R, G, B is an analog signal. The signal voltage ranges from 0 V to 0.7 V. The pixel clock, or in other words the frequency with which the value of this voltage can change, is 80 MHz. Since a certain number of image spots is transmitted per image line, the pixel clock frequency is higher than the line frequency (H-sync) by the number of these spots.

The three color signals R, B, G of the video signal are fed via a video amplifier VA to analog-to-digital converters ADCR, ADCG and ADCB respectively. The two synchronization signals H-sync and V-sync are conditioned in separate circuits HSY, VSY to the effect that the signal edges eroded by transmission and by various EMC processes are regenerated once again. The synchronization signals H-sync and V-sync conditioned in this way are then fed to a microprocessor μP. This microprocessor μP measures their frequency and determines therefrom the resolution adjusted in the graphics card of the computer system. The respective data stored on resolution are then transmitted to a phase-locked loop PLL and, parallel thereto, to a logic circuit designed in the form of an ASIC for conditioning and processing of the digital data.

The phase-locked loop PLL multiplies the frequency of the synchronization signal H-sync with the value transmitted to it by the microprocessor μP. Hereby the sampling frequency (pixel clock) is obtained. By virtue of a delay time caused in the phase-locked loop PLL, a phase difference is established between pixel clock and sampling frequency. These two parameters can be influenced via the OSD displays on the monitor. The sampling frequency obtained in the phase-locked loop is also fed to the three analog-to-digital converters ADCR, ADCG, ADCB. These convert the analog data stream into a digital data stream. The digitized data are finally further processed in the downstream logic circuit ASIC by means of data contained in a video memory VM. Whereas in the simplest case the data are transmitted in 1:1 correspondence to the flat-panel display that can be connected to the logic circuit ASIC, the video memory VM is often used to achieve time decoupling between the arriving data and the data to be transmitted to flat-panel display D. Data stored in video memory VM are also accessed for interpolation of lower resolutions.

Figure 2:
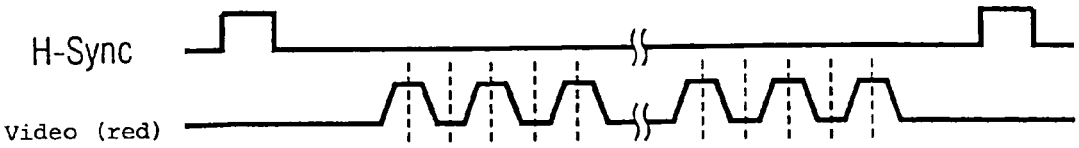

FIG. 2 shows the horizontal synchronization signal H-sync and a video signal of one channel, for example of a red color channel R. The video signal is selected in such a way in FIG. 2 that bright and dark image spots are displayed alternately. The broken lines on the video signal show the ideal sampling instant or the ideal phase for digitization of the analog video data. The broken areas on the first two image spots represent the region of the phase which is just still permissible in order that sampling that is still correct can be achieved. After the phase has been matched, it is therefore located on the broken lines. At a resolution of, for example, 1024×768 image spots (XGA) and 75 Hz image refresh frequency, a fuzzy and highly grainy display is already obtained at a phase shift of 4 ns. Thus matching of the phase is critical for good image quality.

Figure 3:
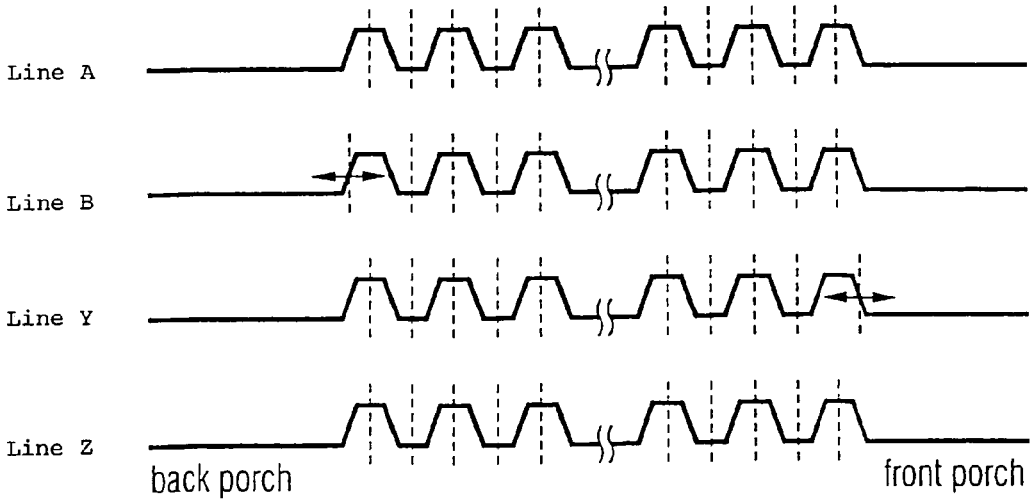

FIG. 3 shows how the information on phase position that is indispensable for closed-loop control is obtained by determining the ideal sampling instant for shifting the phase. If the phase is determined continuously and the determination of phase position were to be related to the entire image, this would cause considerable image distortions unless additional measures were taken. The image distortions occur because the phase of the pixel clock must be shifted in order to determine the most favorable of the various phase positions. If exclusively the phase of the image zone to be examined, and preferably of one individual image spot, is changed, while all other spots continue to be sampled with unchanged phase, image distortion is not perceptible, since it is limited to this very small zone.

FIG. 3 illustrates several lines of the video signal, wherein the information on the ideal phase is obtained, for example, by the method of automatic phase matching described hereinafter. The two image spots on the basis of which the rising and falling edges are to be determined are the first image spot in line B and the last image spot in line Y, where lines A, B, Y and Z are intended to represent arbitrary image lines. The phase necessary for determination of the ideal sampling instant must be confined to one of these two spots at any given time, whereas all other image spots continue to be sampled with the current phase adjustment. For this purpose it is merely necessary that the closed-loop control system have access to the data delivered by the analog-to-digital converters and that the phase can be advanced or retarded selectively for a single image spot to be decided by the closed-loop control system.

Figure 4A:
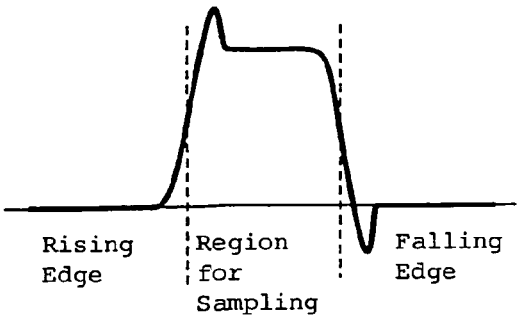
FIGS. 4A and 4B show schematic representations of video signals.
Figure 4B:
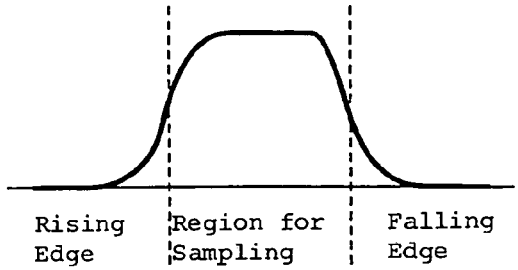
Figure 5:
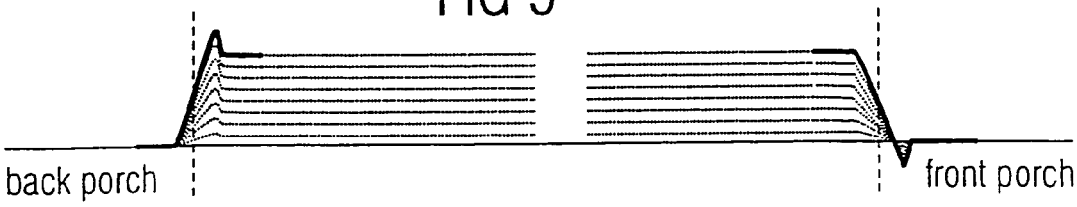
FIG. 5 shows a schematic representation of the rising and falling edges of image spots of a video signal.

From the representations in FIGS. 4A and 4B it can also be seen that the phase of sampling of the video signal plays a large role for image quality, and that, for different video signals, the phase in many cases must be located at correspondingly different places. Thus FIG. 4A shows a fast video signal with overshoots, wherein the region of sampling between the rising and falling edges of the video signal is relatively narrow and is shifted toward the falling edge. In contrast, FIG. 4B shows a slow video signal without overshoots, wherein the region for sampling between the rising edge and the falling edge is relatively broad and substantially centered. Examination of the two signals shows that they have phase positions, for example on the right side in the region of the falling edge of the slow video signal, in which the measured amplitude values are no longer usable for the slow video signal, whereas amplitude values that are still usable are measured at the same phase position of the fast video signal. On the other hand, it is evident that the ideal phase position is located approximately at the midpoint between the rising and falling edges of the video signal and that it must also be adjusted to this value. Thus it is extremely important to adjust the phase as a function of the respective system.

As already mentioned, automatic phase adjustment is more difficult to achieve than the adjustments of the other parameters. Referring now to the figures, it will be described how such an automatic adjustment can be undertaken.

The starting point for determination of phase position is the edges of the video signals. In order to be able to determine an edge, it is advantageous for this to be as pronounced as possible. This is the case when the signal is as slightly pronounced as possible ahead of the edge and as strongly pronounced as possible after the edge, or vice versa. The first requirement is ideally satisfied by the sampling gap between the back-porch and front-porch regions, and the second is satisfied by a bright image spot. Accordingly, a bright image spot at the beginning of a line is highly suitable for determination of the rising edge and one at the end of a line is highly suitable for determination of the falling edge.

The fact that the edges in question may belong to two different spots, which are possibly located on different image lines, is immaterial, because the pixel clock and sampling clock are known and can be taken into consideration appropriately. The chosen image spots should have sufficiently high intensity in at least one primary color (RGB) that an edge of sufficiently large amplitude is found.

In principle, any combination of one bright and one dark image spot, which can be located at arbitrary places in the video signal, is suitable for determining the edges. In most cases, the sought edges can be determined by the combination of front-porch/back-porch region and one bright image spot in the first/last image column. There is then no need to search through the entire image content for two suitable pairs of spots.

As already illustrated hereinabove, the ideal range for sampling the video signal is that in which specified and actual value of the signal are largely in agreement. Measurement of the amplitude of the video signal in the region of the edge, however, is possible only with difficulty. The reason lies in the jitter of the video signal and of the sampling pulse. If this is coarse compared with the rise or fall time of the video signal, the edges can indeed be found by averaging several measurements, but information on the amplitude of the edge at the measured place cannot be obtained.

As explained in the foregoing, the sampling values are averaged over several measurements, in order to average out errors caused by jitter. Although 60 new measured values are available when the image frequency is 60 Hz per second and image spot, the reporting of, for example, ten phase values each with ten measured values, would last close to two seconds. To shorten this time, it is possible to consider several spots per phase value and to sample them less often for this purpose. In this way automatic phase matching proceeds more rapidly.

Figure 6A:
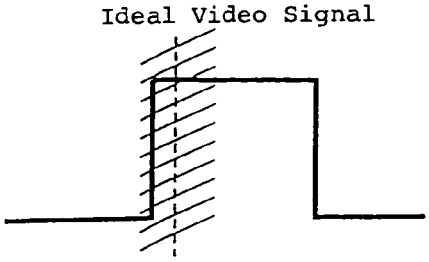
FIGS. 6A and 6B schematically show two ideal video signals and the effect of the position of the sampling pulse in relation to the video signal.
Figure 6B:
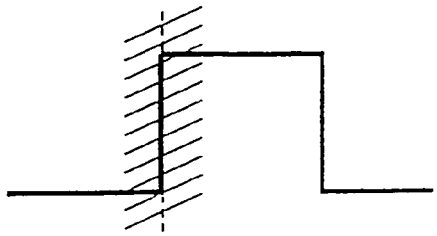

FIGS. 6A and 6B illustrate the problem of detecting the edges. Broken lines representing the desired sampling instant are inserted at the ideal video signals. The hatched area represents the region which, due to the jitter, is actually sampled in the various measurements. If the measured values were to be averaged, an average value of about 80% would be obtained in the first case. This averaged value could be incorrectly interpreted as a location on the rising edge and, in fact, precisely at the place at which this has reached 80% amplitude. This is not the case, however. In the second case, the estimate would be 50%, which already is closer to the true situation.

From these results it is clear that, because of jitter, it will hardly be possible to determine the place on the edge at which this has reached a specified value. Under these circumstances, the least error will usually be made by averaging the measured values at about 50% of the specified value. Obviously other values can also be sought. Smaller values, for example, have the advantage that less accuracy is necessary in determination of the actual amplitude of the image spot.

Hereinafter it will be assumed that the image location and the sampling frequency have already been correctly adjusted. In addition, access to the data of the analog-to-digital converters will be supposed to be possible. The rising edge and the falling edge will be determined as follows, for which purpose the following steps will be performed.

Rising Edge

1. Search for a spot in the first image column which has a sufficiently high, and if at all possible maximal R, G or B value.

2. Since the phase in 1. could have been preadjusted such that the measurement is erroneous, the actual value of the amplitude may be higher. Determine the actual value of the amplitude by a measurement at suitable sampling instant by retarding the phase until the measured amplitude values no longer continue to increase, or by advancing the phase so far at first until the measured amplitude values are very low and this value of the phase, which marks the beginning of the edge, is still retarded by half the pixel width.

3. Shift the phase so far toward the back-porch that the sampling value averaged over several measurements decreases to about 50% of the value determined in 2. Store this value of the phase temporarily, since the rising edge is present here.

Falling Edge

4. Search for one spot in the last image column which has a sufficiently high and if at all possible maximum R, G and B value. In order to obtain the most accurate possible measured values, the phase should be adjusted, before sampling is performed, to the value found in 2.

5. Shift the phase so far toward the front porch that the averaged sampling value decreases to about 50% of the value determined in 4. The falling edge is located at this point.

Alternatively, the sampling instant can also be found by determining the rising edge of a video pulse of a sufficiently bright image spot, and by adjusting the phase such that the sampling instant is shifted approximately by half the width of an image spot toward the pixel center, or alternatively by determining the falling edge of the video pulse at a sufficiently bright image spot, and by adjusting the phase such that the sampling instant is shifted by approximately approximately half the width of an image spot toward the pixel center. Steps 1 to 5 described hereinabove are then correspondingly simplified.

The ideal sampling instant is theoretically located exactly between the two edges. In practice, it may be advantageous to sample at a slight delay from the midpoint between two edges rather than exactly at such midpoint, in order to keep away from possible overshoots of the graphics card and to allow for the often slightly exponential character of the edges.

Depending on the graphics card being used, it is occasionally advantageous to advance or retard the sampling instant slightly relative to the value determined by matching. For this purpose the device is provided with means which allow the user to change the sampling instant compared with the value determined by matching, in which case an offset adjusted in this way is taken into consideration during automatic matching. Via the OSD, for example, the user can change the sampling instant slightly, and this offset is then taken into consideration by the closed-loop control system.

The hardware of the invention comprises a device which determines the rising edge of a video pulse of a sufficiently bright, a device which determines the falling edge of the video pulse at a sufficiently bright image spot, an adjusting device with which the phase is adjusted such that the sampling instant is located approximately at the midpoint between the rising and falling edges of a video pulse, and a device for shifting the phase for determination of the sampling value of the image spot until the measured amplitude values no longer differ significantly, whereupon the sampling value determined then is further processed.

Furthermore, a device is provided which advances the phase used for determination of the sampling value sufficiently that the measured amplitude values are smaller than a predetermined limit value, such as smaller than 50% of the sampling value, and by a device which then retards the phase by half the width of an image spot, whereupon the sampling value measured then is further processed.

Finally, there are provided a device which shifts the phase for determination of the rising edge sufficiently far toward the back-porch region that the measured amplitude value decreases to a predetermined percentage, such as 50% of the previously determined amplitude value, whereupon this value of the phase is stored temporarily as the position of the rising edge, and a device which shifts the phase for determination of the falling edge sufficiently far toward the front-porch region that the measured amplitude value decreases to a predetermined percentage, such as 50% of the previously determined amplitude value, whereupon this value of the phase is stored temporarily as the position of the falling edge.

Figure 7:
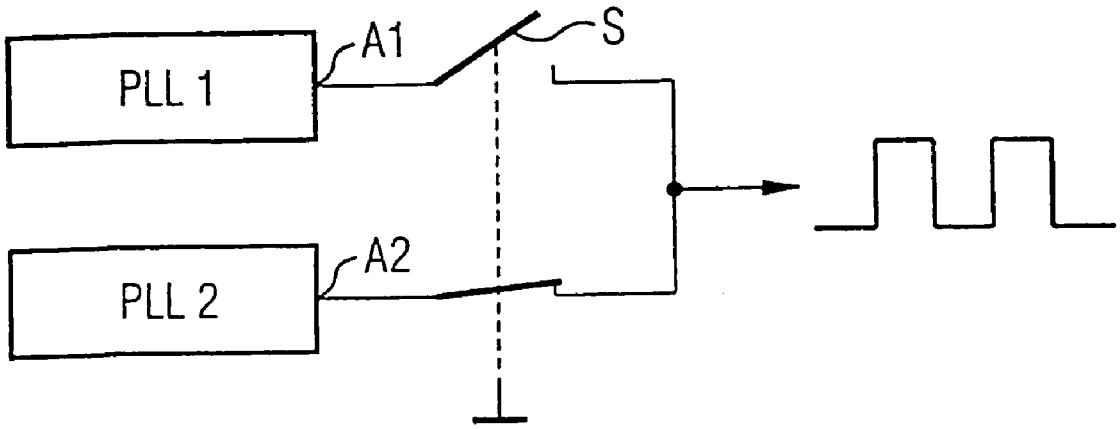
FIG. 7 shows a block diagram of a PLL circuit.

According to FIG. 7, an adjusting device for shifting the phase is provided with a circuit containing two PLL circuits PLL1 and PLL2, whose outputs A1 and A2 can be adjusted independently of one another as regards their phase. The outputs are relayed via a switch S to a common output A. The switch S is an electronic switch, which is operated according to a program.

Figure 8:
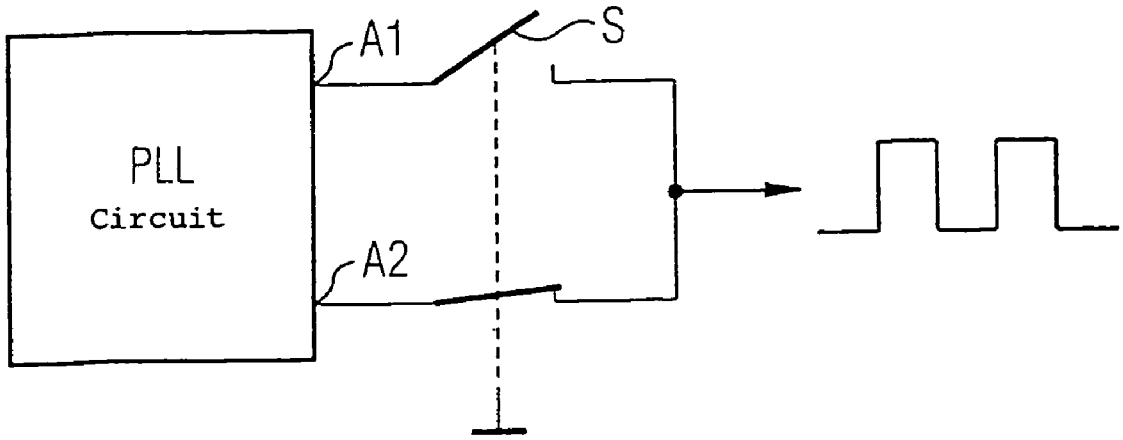
FIG. 8 shows a block diagram of a further PLL circuit.

According to FIG. 8, an adjusting device for shifting the phase is provided with a PLL circuit PLL having two clock outputs A1 and A2, whose output clock signals can be adjusted independently of one another as regards their phase. The two output signals are in turn delivered via a switch S to the output A.

If the one output of the PLL circuit were responsible merely for determination of the ideal sampling phase, whereas the other output of the PLL circuit were to supply the sampling clock for the entire image, the phase determined via the first output would have to be capable of being received at the second output. During reception of the determined ideal phase by the second output, it would be possible for an avoidable error to creep in. In a preferred practical example of the invention, therefore, it is provided that both outputs of the PLL circuit optionally deliver a sampling signal for matching and a sampling signal for the entire image. Thereby the need to receive the phase is eliminated. An electronic changeover unit can decide via the switch S which output is responsible at which instant for which sampling signal. The outputs of the PLL circuit then have the following function, for example, during the closed-loop control process:

| Step | Information to be sampled | Sampling pulse arrives from |
|---|---|---|
| 1. | Edge of the reference spot | Output 1 |
| 2. | Remaining image spots | Output 2 |
| 3. | Repeat steps 1. + 2. until the ideal phase for output 1 has been determined | |
| 4. | Edge of the reference spot | Output 2 |
| 5. | Remaining image spots | Output 1 (with previously determined phase) |
| 6. | Repeat steps 4. + 5. until the ideal phase for output 2 has been determined | |
| 7. | Edge of the reference spot | Output 1 |
| 6. | Remaining image spots | Output 2 (with previously determined phase) |
| 9. | Repeat steps 7. + 8. until the ideal phase for output 1 has been determined | |
| | Repeat steps 4. through 9. cyclically | |

Against the background that the ideal sampling instant is located ½ pixel width after the rising edge or before the falling edge L of a pixel, an embodiment of the invention that is advantageous from the viewpoint of complexity of construction can be designed such that there is provided a PLL circuit which is programmed in such a way that it oscillates with an integral multiple of the needed sampling frequency. Downstream from the PLL circuit there is then connected a frequency divider, which divides the sampling frequency of the PLL circuit by a factor n, wherein n sampling signals phase-shifted by 1/n periods relative to one another can be generated. When n=2 is selected and when the phase of the PLL circuit is adjusted such that the one output is in phase with one edge of the pixel, the other output supplies a clock which is phase-shifted by ½ pixel relative to the edge and thus is ideally suitable for sampling. This arrangement enjoys the advantage that it can be made simply and inexpensively since, instead of two PLL circuits, only two digital elements which supply a phase-shifted signal are needed. Since a very narrow zone around the pixel edge must be examined in order to find the correct phase during matching, it is not a serious drawback for practical purposes that the phases are coupled with one another in this case, or in other words the phase of the actual sampling signal is also adjusted during an adjustment of the sampling phase for matching.

Finally, the following information must also be pointed out: As mentioned hereinabove, an image spot whose intensity satisfies certain minimum requirements must be found for determination of the phase. In this connection, it may be advantageous to determine several image spots with intentionally different intensity. Any slight deviations that may be present in the results could then be averaged out.

The invention claimed is:

1. A method for correcting the phase difference between a pixel clock of a graphics card and a sampling clock of a flat-panel display with an analog interface in a system having a flat-panel display, a graphics card and a computer, comprising:

determining an ideal phase difference between the pixel clock of the graphics card and the sampling clock of the flat panel display; and performing an automatic adjustment of the ideal phase difference repeatedly during continued operation of the display to compensate for phase drift during the continued operation of the display by providing an updated ideal phase difference;

wherein an ideal phase difference adjustment necessary for an instantaneous condition of the system during continued operation of the display is determined only at individual image spots, and the determined ideal phase difference adjustment is then applied to the entire display as the display displays images;

wherein said automatic adjustment of the ideal phase difference comprises selecting a sufficiently bright image spot and the rising edge of a video pulse of this image spot is determined, and the ideal phase difference is adjusted such that a sampling instant for an entire image is situated approximately at the midpoint between rising and falling edges of the video pulse.

2. The method according to claim 1, wherein the automatic adjustment of the ideal phase difference is performed continuously.

3. The method according to claim 1, wherein the automatic adjustment of the ideal phase difference is performed periodically.

4. The method according to claim 1, wherein said automatic adjustment of the ideal phase difference comprises determining a falling edge of a video pulse at a sufficiently bright image spot, and the ideal phase difference is adjusted such that a sampling instant is shifted by approximately half the width of an image spot toward the center of a pixel.

5. The method according to claim 1, wherein an image area and image spots are arrayed on the flat-panel display in rows and columns between a back-porch region and a front-porch region, wherein said automatic adjustment of the ideal phase difference comprises choosing an image spot in a first image column close to the back-porch region as the sufficiently bright image spot for determination of the rising edge and an image spot in the first image column close to the front-porch region is chosen as the sufficiently bright image spot for determination of the falling edge.

6. The method according to claim 1, wherein said automatic adjustment of the ideal phase difference further comprises measuring the brightness of a plurality of image spots of the first or last image column and choosing the image spots with the greatest brightness in the first or last image column for determination of the rising or falling edge respectively of the video pulse.

7. The method according to claim 1, wherein said automatic adjustment of the ideal phase difference further comprises measuring image spots (n×k) are with n=1,2, . . . N and k=constant, and, if no sufficiently bright image spot is found, the image spots (n+m)×k are measured with m=1, 2, . . . N, until a sufficiently bright image spot is found.

8. The method according to claim 1, wherein said automatic adjustment of the ideal phase difference further comprises for determination of the amplitude values of the selected image spots, shifting the phases at these image spots until the measured amplitude values no longer change significantly, and further processing the amplitude values determined.

9. The method according to claim 1, wherein said automatic adjustment of the ideal phase difference further comprises advancing the phase used for determination of amplitude values sufficiently so that measured amplitude values are smaller than a predetermined limit value delaying the phase by half the width of a spot, and further processing the measured amplitude value.

10. The method according to claim 1, wherein said automatic adjustment of the ideal phase difference further comprises determining the rising edge of the selected image spots, shifting the phase at the selected image spot sufficiently toward the back-porch region so that a measured amplitude value is reduced to a predetermined percentage-of a previously determined amplitude value, and storing this value of the phase temporarily as the position of the rising edge.

11. A method according to claim 1, wherein said automatic adjustment of the ideal phase difference further comprises determining the falling edge of the selected image spots, shifting the phase at the selected image spot sufficiently toward the front-porch region so that a measured amplitude value is reduced to a predetermined percentage a previously determined amplitude value, and storing this value of the phase temporarily as the position of the falling edge.

12. A method according to claim 1, further comprising delaying the phase or sampling instant relative to the midpoint between the rising and falling edges by a predetermined amount.

13. The method according to claim 12, further comprising repeatedly regenerating a video memory.

14. A method according to claim 1, further comprising masking pixel or pixels that is or are influenced or distorted during determining the ideal phase difference by masking such pixel or pixels with distortion-free image fragments from a video memory.

15. The method according to claim 1, further comprising creating an offset wherein the sampling instant can be changed by a user compared with the value determined during determining the ideal phase difference in which case said offset is used during an automatic matching.

16. The method according to claim 1, wherein when performing an automatic adjustment of the ideal phase difference, the adjusted ideal phase difference may be unchanged from the immediately preceding one.

17. A device for correcting the phase difference between the pixel clock of a graphics card and the sampling clock of a flat-panel display with an analog interface in a system having a flat-panel display, a graphics card and a computer, comprising:

a processor for repeatedly determining an ideal phase difference between a pixel clock of a graphics card and a sampling clock of a flat panel display; and an adjusting circuit which repeatedly performs an automatic adjustment of the ideal phase difference during the continued operation of the display to compensate for phase drift during the continued operation of the display and to provide an updated ideal phase difference;

wherein the adjusting circuit determines the rising edge of a video pulse of a sufficiently bright image spot, determines the falling edge of the video pulse at a sufficiently bright image spot, and the phase is adjusted such that the sampling instant is located at approximately the midpoint between the rising and the falling edges of a video pulse.

18. The device according to claim 17, wherein the automatic adjustment of the ideal phase difference is performed continuously or periodically.

19. The device according to claim 17, wherein the adjusting circuit for adjusting the phase further comprises a circuit containing two PLL circuits, with outputs which can be adjusted independently of one another as regards their phase.

20. The device according to claim 17, wherein the adjusting circuit for shifting the phase further comprises a PLL circuit with two clock outputs with output clock signals which can be adjusted independently of one another as regards their phase.

21. The device according to claim 20, wherein the two outputs of the PLL circuit deliver a sampling clock signal for matching and a sampling signal for the entire image.

22. The device according to claim 21, wherein the sampling clock is delivered alternately by the two outputs of the PLL circuit.

23. The device according to claim 17, wherein the adjusting circuit is structured to make a phase adjustment necessary for the instantaneous condition of the system which is determined only at individual image spots, and by which the determined phase adjustment is then applied to the entire image.

24. The device according to claim 17, wherein a PLL circuit which is programmed such that it oscillates at an integral multiple of the needed sampling frequency, and by a downstream frequency divider, which divides the sampling frequency of the PLL circuit by a factor n, wherein n sampling signals phase-shifted by I/n periods relative to one another can be generated.

25. The device according to claim 24, wherein a factor n=2 is used and wherein the phase difference of the PLL circuit is adjusted such that one sampling signal is in phase with one edge of the pixel, and the other sampling signal is shifted by ½ pixel in its phase difference.

26. A device for correcting the phase difference between the pixel clock of a graphics card and the sampling clock of a flat-panel display with an analog interface in a system having a flat-panel display, a graphics card and a computer, comprising:

a processor for repeatedly determining an ideal phase difference between a pixel clock of a graphics card and a sampling clock of a flat panel display; and an adjusting circuit which repeatedly performs an automatic adjustment of the ideal phase difference during the continued operation of the display to compensate for phase drift during the continued operation of the display and to provide an updated ideal phase difference;

wherein the adjusting circuit determines the rising edge of a video pulse of a sufficiently bright image spot, and the phase is adjusted such that the sampling instant is shifted by approximately half the width of an image spot toward the center of the pixel.

27. A device for correcting the phase difference between the pixel clock of a graphics card and the sampling clock of a flat-panel display with an analog interface in a system having a flat-panel display, a graphics card and a computer, comprising:

a processor for repeatedly determining an ideal phase difference between a pixel clock of a graphics card and a sampling clock of a flat panel display; and an adjusting circuit which repeatedly performs an automatic adjustment of the ideal phase difference during the continued operation of the display to compensate for phase drift during the continued operation of the display and to provide an updated ideal phase difference;

wherein the adjusting circuit determines the falling edge of a video pulse at a sufficiently bright image spot, and the phase is adjusted such that the sampling instant is shifted by approximately half the width of an image spot toward the center of the pixel.

28. A device for correcting the phase difference between the pixel clock of a graphics card and the sampling clock of a flat-panel display with an analog interface in a system having a flat-panel display, a graphics card and a computer, comprising:

a processor for repeatedly determining an ideal phase difference between a pixel clock of a graphics card and a sampling clock of a flat panel display; and an adjusting circuit which repeatedly performs an automatic adjustment of the ideal phase difference during the continued operation of the display to compensate for phase drift during the continued operation of the display and to provide an updated ideal phase difference;

wherein the adjusting circuit for shifting the phase for determination of the sampling value of the image spot until the measured amplitude values no longer differ significantly, whereupon the sampling value determined then is further processed.

29. A device for correcting the phase difference between the pixel clock of a graphics card and the sampling clock of a flat-panel display with an analog interface in a system having a flat-panel display, a graphics card and a computer, comprising:

a processor for repeatedly determining an ideal phase difference between a pixel clock of a graphics card and a sampling clock of a flat panel display; and an adjusting circuit which repeatedly performs an automatic adjustment of the ideal phase difference during the continued operation of the display to compensate for phase drift during the continued operation of the display and to provide an updated ideal phase difference;

wherein the adjusting circuit advances the phase used for determination of the sampling value sufficiently that the measured amplitude values are smaller than a predetermined limit value, such as smaller than 50% of the sampling value, and by a device which then retards the phase by half the width of an image spot, whereupon the sampling value measured then is further processed.

30. A device for correcting the phase difference between the pixel clock of a graphics card and the sampling clock of a flat-panel display with an analog interface in a system having a flat-panel display, a graphics card and a computer, comprising:

a processor for repeatedly determining an ideal phase difference between a pixel clock of a graphics card and a sampling clock of a flat panel display; and an adjusting circuit which repeatedly performs an automatic adjustment of the ideal phase difference during the continued operation of the display to compensate for phase drift during the continued operation of the display and to provide an updated ideal phase difference;

wherein the adjusting circuit shifts the phase for determination of the rising edge sufficiently far toward a back-porch region that the measured amplitude value decreases to a predetermined percentage, such as 50% of the previously determined amplitude value, whereupon this value of the phase is stored temporarily as the position of the rising edge.

31. A device for correcting the phase difference between the pixel clock of a graphics card and the sampling clock of a flat-panel display with an analog interface in a system having a flat-panel display, a graphics card and a computer, comprising:

a processor for repeatedly determining an ideal phase difference between a pixel clock of a graphics card and a sampling clock of a flat panel display; and an adjusting circuit which repeatedly performs an automatic adjustment of the ideal phase difference during the continued operation of the display to compensate for phase drift during the continued operation of the display and to provide an updated ideal phase difference;

wherein a device which shifts the phase for determination of the falling edge sufficiently far toward the front-porch region that the measured amplitude value decreases to a predetermined percentage whereupon this value of the phase is stored temporarily as the position of the falling edge.

32. A device for correcting the phase difference between the pixel clock of a graphics card and the sampling clock of a flat-panel display with an analog interface in a system having a flat-panel display, a graphics card and a computer, comprising:

a processor for repeatedly determining an ideal phase difference between a pixel clock of a graphics card and a sampling clock of a flat panel display; and an adjusting circuit which repeatedly performs an automatic adjustment of the ideal phase difference during the continued operation of the display to compensate for phase drift during the continued operation of the display and to provide an updated ideal phase difference;

wherein the adjusting circuit uses an offset by which the sampling instant can be changed by the user compared with the value determined during matching, in which case said offset is used during automatic matching.

33. A method for correcting the phase difference between a pixel clock of a graphics card and a sampling clock of a flat-panel display with an analog interface in a system having a flat-panel display, a graphics card and a computer, comprising:

determining an ideal phase difference between the pixel clock of the graphics card and the sampling clock of the flat panel display;

performing an automatic adjustment of the ideal phase difference repeatedly during continued operation of the display to compensate for phase drift during the continued operation of the display by providing an updated ideal phase difference based on which a sampling instant for the entire image is situated approximately at a midpoint between the rising and falling edges of a video pulse.

34. A method for correcting the phase difference between a pixel clock of a graphics card and a sampling clock of a flat-panel display with an analog interface in a system having a flat-panel display, a graphics card and a computer, comprising:

determining an ideal phase difference between the pixel clock of the graphics card and the sampling clock of the flat panel display;

performing an automatic adjustment of the ideal phase difference repeatedly during continued operation of the display to compensate for phase drift during the continued operation of the display by providing an updated ideal phase difference;

wherein the ideal phase difference adjustment necessary for an instantaneous condition of the system during continued operation of the display is determined only at individual image spots, and the determined ideal phase difference adjustment is then applied to the entire display as the display displays images; and wherein the updated ideal phase difference is such that a sampling instant for the entire image is situated approximately at a midpoint between the rising and falling edges of a video pulse.

35. A method for correcting the phase difference between a pixel clock of a graphics card and a sampling clock of a flat-panel display with an analog interface in a system having a flat-panel display, a graphics card and a computer, comprising:

determining an ideal phase difference between the pixel clock of the graphics card and the sampling clock of the flat panel display; and performing an automatic adjustment of the ideal phase difference repeatedly during continued operation of the display to compensate for phase drift during the continued operation of the display by providing an updated ideal phase difference;

wherein an ideal phase difference adjustment necessary for an instantaneous condition of the system during continued operation of the display is determined only at individual image spots, and the determined ideal phase difference adjustment is then applied to the entire display as the display displays images;

wherein said automatic adjustment of the phase difference comprises determining a rising edge of a video pulse of a sufficiently bright image spot and the ideal phase difference is adjusted such that a sampling instant is shifted by approximately half the width of an image spot toward the center of a pixel.

* * * * *